US010867589B2

(12) United States Patent
Sikra

(10) Patent No.: US 10,867,589 B2
(45) Date of Patent: Dec. 15, 2020

(54) PERCUSSION PEDAL SYSTEM

(71) Applicant: DRUM WORKSHOP, INC., Oxnard, CA (US)

(72) Inventor: Richard A. Sikra, Thousand Oaks, CA (US)

(73) Assignee: DRUM WORKSHOP, INC., Oxnard, CA (US)

( * ) Notice: Subject to any disclaimer, the term of this patent is extended or adjusted under 35 U.S.C. 154(b) by 351 days.

(21) Appl. No.: 15/409,428

(22) Filed: Jan. 18, 2017

(65) Prior Publication Data

US 2017/0206868 A1 Jul. 20, 2017

Related U.S. Application Data

(60) Provisional application No. 62/281,089, filed on Jan. 20, 2016.

(51) Int. Cl.
*G10D 13/02* (2020.01)
*G10D 13/11* (2020.01)

(52) U.S. Cl.
CPC ..... *G10D 13/11* (2020.02)

(58) Field of Classification Search
CPC ..... G10D 13/006
USPC ..... 84/422.1, 422.2, 422.3
See application file for complete search history.

(56) References Cited

U.S. PATENT DOCUMENTS 3,147,661 A 9/1964 Padera
3,747,464 A 7/1973 Russell
4,747,333 A * 5/1988 Hoshino ..... G10D 13/006 84/422.1
5,301,592 A 4/1994 Johnston
5,994,635 A 11/1999 Hoshino
6,590,147 B2 7/2003 Kassabian
6,794,565 B2 * 9/2004 Green ..... G10D 13/006 84/327
6,906,252 B2 6/2005 Matsuzoe
7,262,356 B1 8/2007 Lukios
(Continued)

FOREIGN PATENT DOCUMENTS

DE 202010004042 8/2010

OTHER PUBLICATIONS

U.S. Appl. No. 29/552,167, filed Apr. 19, 2017, Chandontrikit, et al.
(Continued)

*Primary Examiner* — Jianchun Qin
(74) *Attorney, Agent, or Firm* — Ferguson Case Orr Paterson

(57) ABSTRACT

Drum pedal systems are disclosed which can include separate pedal and beater portions connected by a connecting portion. The connecting portion can be flexible such that the location of the beater portion can be adjusted relative to the location of the pedal portion. The pedal and beater portions can be disconnected from one another for improved transportability. The pedal portion may include a roller beneath the pedal so as to increase the smoothness of play. The angle of the beater can be laterally adjusted, thus causing the contact point on a drum to be lower or higher as desired. The beater portion can include a beater axis that is relatively low to the ground, which can aid in preventing a user's hands and the beater striking a percussion instrument at the same height.

21 Claims, 9 Drawing Sheets

(56) References Cited

U.S. PATENT DOCUMENTS

| | | | | |
|---|---|---|---|---|
| 7,365,258 | B1 | 4/2008 | Lombardi | |
| 8,455,746 | B2 | 6/2013 | Johnston | |
| 8,624,097 | B1 * | 1/2014 | Liao | G10D 13/006 84/422.1 |
| 9,087,497 | B1 | 7/2015 | Krol et al. | |
| 9,875,730 | B2 | 1/2018 | Cannon | |
| 2006/0150801 | A1 | 7/2006 | Veiga | |
| 2011/0271818 | A1 | 11/2011 | Simon | |
| 2012/0097011 | A1 | 4/2012 | Leopold | |
| 2012/0144976 | A1 * | 6/2012 | Johnston | G10D 13/006 84/422.1 |
| 2012/0180617 | A1 * | 7/2012 | Dorfman | G10D 13/065 84/422.3 |
| 2015/0059555 | A1 | 3/2015 | Liao | |
| 2015/0082968 | A1 | 3/2015 | Sikra | |
| 2016/0210946 | A1 | 7/2016 | Sikra | |

OTHER PUBLICATIONS

U.S. Appl. No. 62/281,089, filed Jan. 20, 2016, Sikra.
International Search Report of Application No. PCT/US17/13993, dated Oct. 5, 2017.
Office Action for U.S. Appl. No. 15/873,269, dated Feb. 21, 2020.
Office Action for U.S. Appl. No. 16/255,503, dated Jul. 23, 2020.
Office Action for U.S. Appl. No. 15/873,269, dated Jul. 15, 2020.

* cited by examiner

PERCUSSION PEDAL SYSTEM

This application claims the benefit of U.S. Provisional Patent Application 62/281,089 to Sikra, filed on Jan. 20, 2016 and entitled "Percussion Pedal System," which is fully incorporated by reference herein in its entirety.

BACKGROUND OF THE DISCLOSURE

Field of the Disclosure

Aspects of the present disclosure generally relate to percussive instruments, and more specifically, the present disclosure relates to a percussion pedal system.

Description of the Related Art

Musical notes have been created using many forms of instruments and devices. Percussion instruments, i.e., those that generate sound by being beaten, rattled, and/or vibrated, are sometimes considered to be the oldest type of musical instrument. There are many types of percussion instruments; the drum is considered a classic example of a percussive instrument.

A drum may be sounded by striking some portion of the drum with the hand. Some drums may also generate different tonal sounds when struck with a beater, mallet, or stick. Some musical genres utilize various different percussive sounds and tones to evoke different feelings in the listener; as such, different types of beaters, as well as the drummer's hand, may be used to produce various tones from a given drum.

Depending on the type of music being played, different tonal qualities of an instrument may be more desirable. For example, a flamenco style piece may emphasize different tonalities and tonal relationships between notes than a jazz style of music. Some musical pieces employ different consonance (relaxation and/or harmonization) and dissonance (tension and/or conflict) between the tonic (the central note of a chord or piece of music) and the other notes in a musical composition. As such, different beaters, or hand-beater combinations, may be desirable for some drums.

Some drums use foot-operated devices, sometimes referred to as "drum pedals" or "drum pedal assemblies" to operate and/or control a beater (also referred to as a "mallet" herein) that strikes a drum. The drum pedal may be operated in conjunction with the drummer's hand, such that the drum can be played with the hand to create one tone and the drum pedal/beater to create another tone, without the drummer removing and replacing the beater in their hand. Such an arrangement allows for faster playing as well as allowing the drummer to play more complicated/technical pieces.

Variations in drummer technique mean that it is very difficult to design a single system to meet the needs of every drummer and playing style. Such variables can include drummer playing style and the areas of a drum where the drummer typically strikes with the hand or beater. Hand/beater combination play is often used with a cajon—a percussion instrument that is typically a hollow box shape. Examples of cajons are described and shown, for example, in commonly assigned U.S. Pat. No. 9,087,497 to Krol et al. and U.S. Des. Pat. App. No. 29/552,167 to Chandontrikit, each of which is fully incorporated by reference herein in its entirety. One specific example of a cajon and pedal system designed to allow for cajon play with both a hand and a beater is described in commonly assigned U.S. Pat. No. 7,365,258 to Lombardi, which is fully incorporated by reference herein in its entirety.

Adjustable pedals can provide the customization necessary to achieve some or all of a drummer's desired pedal characteristics as well as placing the beater in a location that will produce desired tonal characteristics from the drum without interfering with the drummer's hands beating the drum. Some pedals with adjustable features are described in U.S. Pat. Nos. 5,301,592 and 8,455,746 to Johnston, U.S. Pat. No. 6,590,147 to Kassabian, and U.S. Pat. Pub. No. 2015/0082968 to Sikra, each of which is fully incorporated by reference herein in its entirety.

Adjustment mechanisms provided in the related art can be unwieldy, which can increase difficulty to the user, and/or can lack adjustability of a variable which is independent of other variables, thus reducing the amount of customization available via adjustments. Further, many related art systems merely adapt a drum pedal designed for one type of drum to another, which may not provide a drummer with proper placement of the beater/mallet to play in a comfortable manner. This can lead to diminished performance and/or injury/uncomfortableness to the drummer.

SUMMARY OF THE DISCLOSURE

Some embodiments of the present disclosure are directed toward percussion beater systems and components thereof, where the pedal portion and the beater portion are distal from one another and separated by a connector, such as a cable, that allows actuation of the pedal to cause movement of at least a portion of the beater portion.

One embodiment of a percussion beater system according to the present disclosure includes a pedal portion having a drum pedal and a beater portion having a beater rod holder. A connecting portion including a flexible linking member connects the drum pedal portion and the beater portion such that actuation of the drum pedal causes movement of the beater rod holder.

One embodiment of a drum pedal assembly according to the present disclosure includes a base plate and a pedal on the base plate, a drive shaft on a front portion of the base plate, an arm between the drive shaft and an underside of the pedal, and a roller between the arm and the pedal underside.

One embodiment of a beater assembly according to the present disclosure includes a body and a beater rod holder, and a drive shaft between the two. A connector is operably linked to the drive shaft such that movement of the connector causes rotation of the drive shaft.

The above summary has outlined, rather broadly, some features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same or similar purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION OF THE DISCLOSURE

Overview

Figure 1:
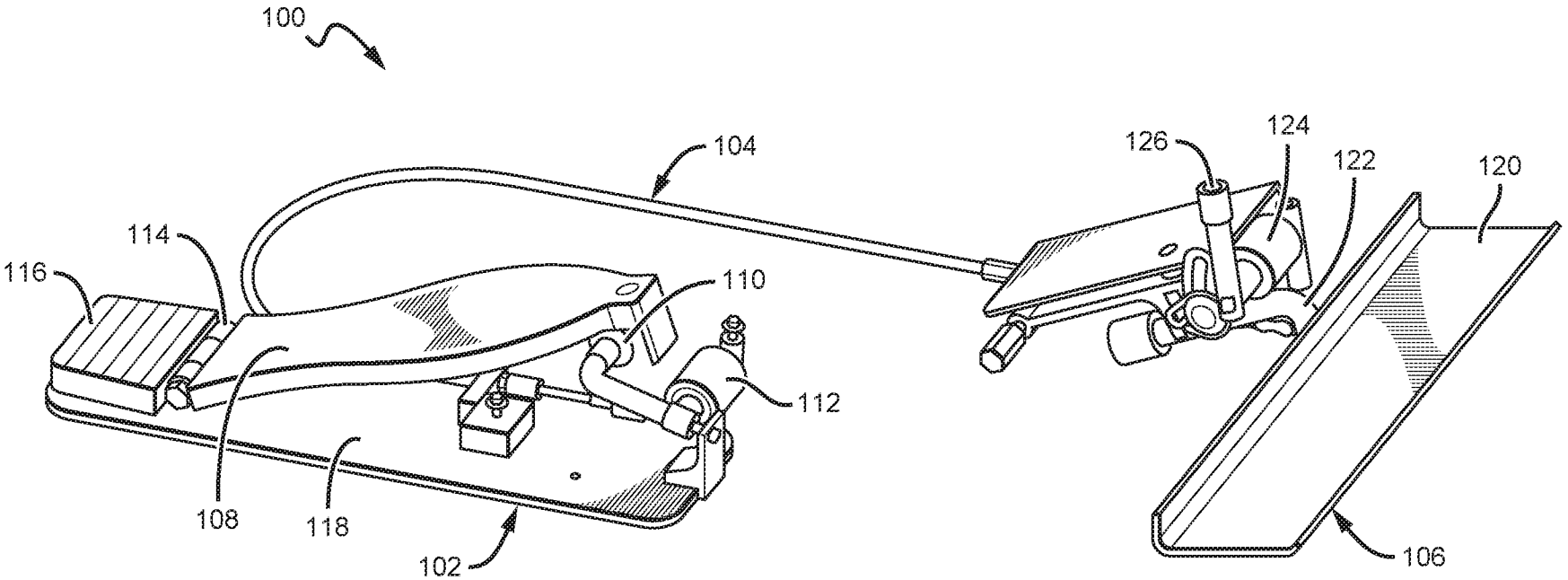
FIG. 1 illustrates one embodiment of a percussion pedal system in accordance with an aspect of the present disclosure.

Music, and musical compositions such as songs, are often written and/or composed to evoke emotions and/or feelings in the listener. Musical presentations combine tones and harmonics (also known as "overtones") to tell a story. Many different types of musical instruments, e.g., stringed instruments, percussive instruments, wind instruments, etc., may be used, alone or in combination, to present an artist's interpretation of a feeling and/or emotion through auditory stimuli.

The underlying tonality, rhythm, and/or "beat" of a piece of music are often provided by percussion instruments, e.g., drums. The tonal qualities of a particular type of drum, referred to as a "cajon," is prevalent in flamenco, jazz, Cuban rumba, and Peruvian music. Although discussed herein with respect to a cajon, the system described herein may be used with other percussive instruments without departing from the scope of the present disclosure.

A cajon is nominally a six-sided, box-shaped instrument, where the drummer or player sits on top of the cajon and slaps the front face, rear face, and/or sides of the instrument with the palms or fingers. The faces of the cajon may also be struck with a stick, beater, mallet, brush, or other implement to create a different sound or generate a faster beat than can be accomplished with just the hands.

Since the player is often sitting on top of the cajon, using a bass drum pedal may be difficult as the pedal for a bass drum is designed to point away from the player. As such, use of a typical bass drum pedal when playing a cajon creates an awkward playing position. Further, because the bass drum pedal is designed to strike the bass drum at approximately the same height as the cajon player's hands, the use of a bass drum pedal to play the cajon in addition to hand/finger playing often restricts some form of playing the instrument.

The detailed description set forth herein, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those reasonably skilled in the art that these concepts may be practiced without these specific details. In some instances, structures and components are shown in block diagram form in order to aid in avoiding obscuring such concepts. As described herein, the use of the term "and/or" is intended to represent an "inclusive OR", and the use of the term "or" is intended to represent an "exclusive OR".

It is understood that when an element is referred to as being "on," "attached to," "connected to," or similar to another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

System Diagram

FIG. 1 illustrates one embodiment of a percussion pedal system according to the present disclosure.

System 100 comprises a pedal portion 102, a connecting portion 104, and a beater portion 106. The pedal portion 102 may be positioned at a comfortable and/or customizable location for the user's foot, while beater portion 106 is positioned proximate to a drum or other percussive instrument. The connecting portion 104 is flexible and/or moveable with respect to pedal portion 102 and beater portion 106, such that the relative placements of pedal portion 102 and beater portion 106 may be varied and/or changed.

Pedal portion 102 can include a pedal 108, roller 110, and drive shaft 112. Pedal 108 may include a hinge 114 and optionally comprises a heel plate 116. As pedal 108 is pressed, pedal 108 rotates about an axis of hinge 114. Pressing on pedal 108 also moves the opposite end of pedal 108 toward a base 118 of pedal portion 102, which engages roller 110. Roller 110 moves along a bottom surface of pedal 108 (e.g., a surface opposite where a user's foot may engage pedal 108), and rotates or otherwise engages a drive shaft 112. As drive shaft 112 rotates, connecting portion 104 is engaged and moved. Roller 110 may ride in a groove on pedal 108, a raised portion of pedal 108, or on any surface of pedal 108 to provide a specific feel and/or playing action to a drummer. Drive shaft 112 may also be coupled closer to hinge 114, or adjustable with respect to the distance between drive shaft 112 and hinge 114, to customize the height of pedal 108 when at a resting position.

Roller 110 provides a smooth movement of drive shaft 112. Such smooth movement of roller 110 on pedal 108 provides a better "feel" or "playing action" to a drummer playing a drum when employing system 100. The diameter of roller 110 may be selected to provide a large movement of drive shaft 112 with a small movement of pedal 108, or may be selected to provide a linear movement of drive shaft 112 with movement of pedal 108. In one embodiment of the present disclosure, the roller has a diameter of between about 0.25 inch and 2 inches, and/or between about 0.5 inch and 1 inch, and/or about 0.75 inch, all inclusive. Many possible relative movements of drive shaft 112 with respect to movement of pedal 108 are possible within the scope of the present disclosure. Further, roller 110 may have a cam or elliptical, oval, or other non-circular shape, and the primary axis of roller 110 may be adjusted with respect to a resting position of pedal 108 to customize the motion of pedal 108 in generating motion in the beater portion 106.

As drive shaft 112 moves, connecting portion 104, which may be a cable such as a sheathed cable, also moves. For example, and not by way of limitation, drive shaft 112 may rotate and pull a cable (part of connecting portion 104) that is coupled to beater portion 106, which then can move a part within beater portion 106. Connecting portion 104 may be a linkage, a push-rod mechanical connector, or other actuator and/or device to translate motion in the beater portion 106. While the embodiment shown in FIG. 1 and those described below refer to a "cable," it is understood that any linking member may be used, such as a rope, wire, chain, rigid device, etc.

Beater portion 106 can include a bracket 120, a rod 122, a drive shaft 124, and a beater rod holder 126. At least a portion of bracket 120 may be placed under a drum and/or cajon to position and/or hold beater portion 106 in proximity to a drum and/or cajon. Bracket 120 may be shaped to accommodate various different shapes of drums, e.g., round, square, crescent shaped, partially crescent shaped, etc., without departing from the scope of the present disclosure. Further, some embodiments of the present disclosure do not include a bracket.

Rod 122 can be coupled to bracket 120, and may comprise a standard diameter rod used in percussive instrument design and/or manufacture if desired. For example, and not by way of limitation, rod 122 may be a ½ inch diameter rod, such that readily available mounting hardware may be used to couple drive shaft 124 to rod 122.

Beater portion 106 is coupled to connecting portion 104 such that drive shaft 124 motion (e.g., rotation) is initiated by motion of pedal 108. Motion of pedal 108, which may be created by pressure of a drummer's foot, is transferred through connecting portion 104 to drive shaft 124. As drive shaft 124 is moved by connecting portion 104 (vis-à-vis pedal 108 and drive shaft 112), drive shaft 124 transfers movement to beater rod holder 126. Beater rod holder 126 is configured to accept a beater (and/or mallet) for use in striking a drum and/or cajon.

Pedal Portion

Figure 2:
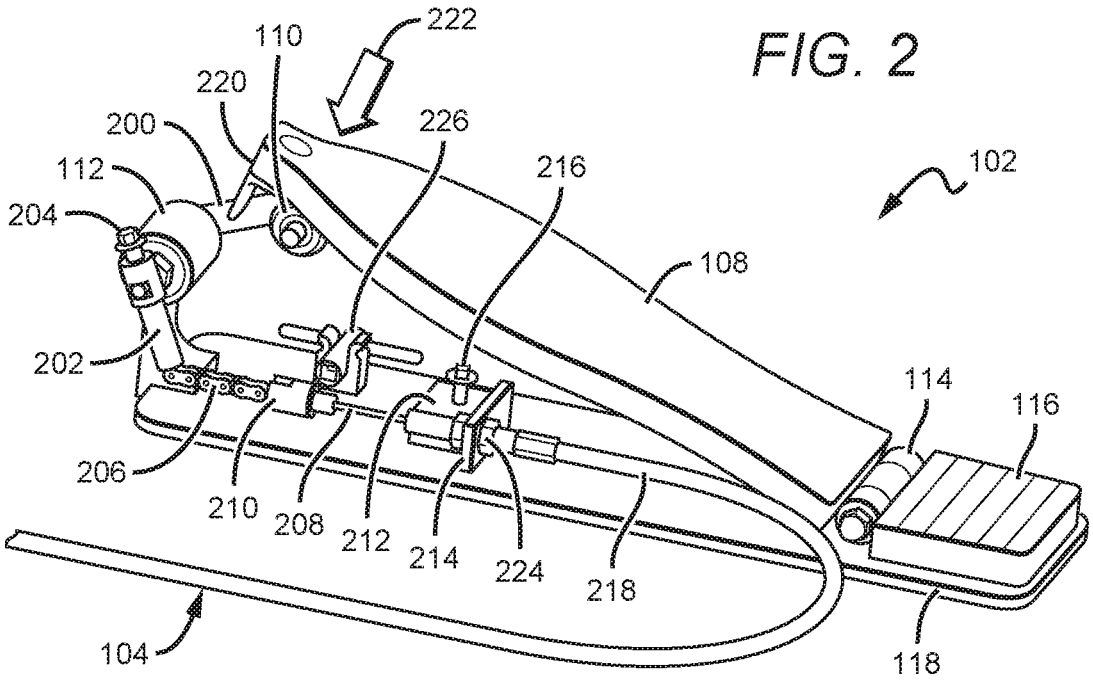
FIG. 2 illustrates one embodiment of a pedal portion of a system in accordance with an aspect of the present disclosure.

FIG. 2 illustrates a pedal portion 102 of a system in accordance with an aspect of the present disclosure. It is understood that many other pedal portions can be used as part of systems according to the present disclosures, such as pedals and components described in commonly assigned U.S. Pat. Pub. No. 2015/0082968 to Sikra, which is fully incorporated by reference herein in its entirety.

In an aspect of the present disclosure, pedal portion 102 may also comprise a roller arm 200 (or other style of arm or connection), which couples roller 110 to drive shaft 112. Drive shaft 112 is coupled to arm 202, and is secured to arm 202 with nut 204. Arm 202 is also coupled to chain 206 or another type of connector which may be rigid, flexible (e.g. rope, strap, etc.), or otherwise, which then couples to cable 208 at connector 210. It is understood that cable 208 may connect directly to arm 202 and/or drive shaft 112 without use of chain 206. Cable 208 can pass through a housing 212, which is coupled to plate 214 by nut 216. After passing through housing 212, cable 208 can enter a housing or sheath 218 which may be part of connecting portion 104, although the housing/sheath 218 is not strictly necessary (but has the benefit of providing environmental protection to cable 208). Pedal 108 may optionally comprise a stop 220 to stop roller 110 from disengaging from pedal 108 and/or to set a maximum actuation position of pedal 108.

In an aspect of the present disclosure, pedal portion 102 may be operated by depressing pedal 108 in direction 222. Pressure on pedal 108 in direction 222 moves roller along pedal 102 towards hinge 114, which moves roller arm 200 that is attached to roller 110. As roller arm 200 moves, drive shaft 112 is rotated, which rotates arm 202. The rotation of arm 202, which is a clockwise rotation in the perspective of FIG. 2, pulls chain 206 away from hinge 114. This motion of chain 206 also moves cable 208. The other end of cable 208 is coupled to beater portion 106, which will be described herein below.

In an aspect of the present disclosure, the engagement of drive shaft 112 may be adjusted by adjusting one or more nuts 224 coupled to housing 212. As the nut 224 is moved with respect to plate 214, the relative tension on cable 208 may be adjusted, thereby adjusting where in the motion along direction 222 that drive shaft 112 is engaged. Similarly, the relative angles of coupling between roller arm 200 and drive shaft 112, and/or the coupling angle between arm 202 and drive shaft 112, may also affect the engagement point of pedal 108 with respect to movement of cable 208. These angles can be also be adjusted such as (for the arm 202, though the same or similar system can apply to arm 200) loosening nut 204, adjusting the angle of arm 202 relative to drive shaft 112, and retightening nut 204. Further, the length of chain 206, size of roller 110, length of roller arm 200 (i.e., between roller 110 and drive shaft 112) may also be adjusted to change the engagement point of pedal 108 in terms of motion of cable 208.

The adjustment of the engagement point of pedal 108 is important to drummers, in that different engagement points will raise or lower the height of pedal 108 with respect to base 118. In such adjustments, the angle that a drummer's ankle must take to have the pedal 108 not move cable 208 (and thus not move the beater rod holder 126) can be varied, as well as the amount of movement of pedal 108 that must be undertaken in direction 222 to produce sound from a drum coupled to beater portion 106. These adjustments allow for customization of the system 100 to each individual drummer, as well as different types of drums, without producing several different types of systems 100.

Connecting portion 104 may be removed from pedal portion 102 by loosening nut 216, and removing plate 214 from base 118. In an aspect of the present disclosure, multiple nuts 224 may be used to maintain the tension of cable 208 with respect to arm 202. Nuts 204 and 216, as well as other nuts used in the system 100, may be standardized if desired with respect to other hardware employed in drum/percussion instruments. As such, a wrench 226 may be mounted in a clip or otherwise attached to base 118, or elsewhere in system 100, for ease of disassembly of pedal portion 102 from connecting portion 104. The connection between plate 214 and housing 212 can include any type of connection in the art. In one embodiment a magnetic connection and/or a male/female connection are used.

The advantage of disassembly within system 100, in an aspect of the present disclosure, allows for easier portability of system 100, and also allows for installation of one or more portions of system 100 in specific locations. For example, and not by way of limitation, pedal portion 102 may be mounted on a plate, beater portion 106 may be mounted on a drum, etc., and the system 100 can still be assembled and/or disassembled in a relatively quick and easy fashion. Further, one portion of system 100 is not tethered to the other portion(s) permanently, and thus can be interchanged with other embodiments of system components if desired. For example, the beater portion 106, connecting portion 104 can be disconnected from the pedal portion 102 by loosening and removing plate 214 and arm 202, or by other methods. Not by way of limitation, a beater portion 106 of one system may be used with a pedal portion 102 of another system without departing from the scope of the present disclosure.

Beater Portion

Figure 3:
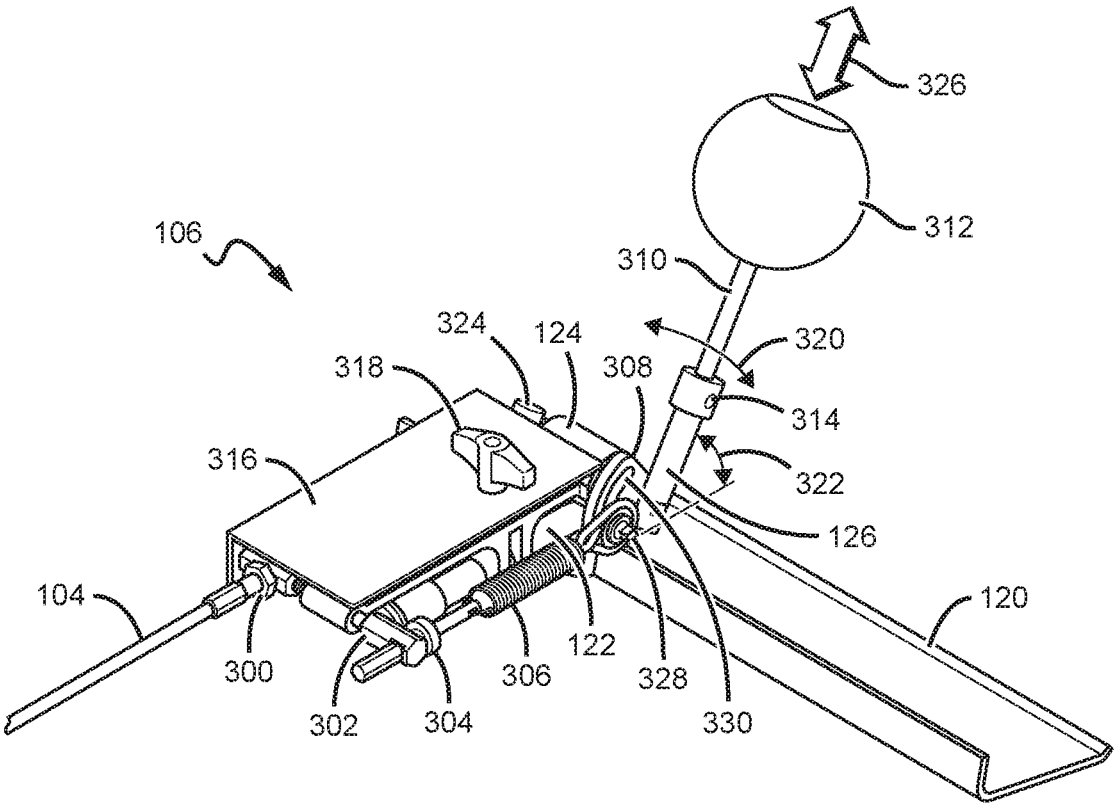
FIG. 3 illustrates one embodiment of a beater portion of a system in accordance with an aspect of the present disclosure.

FIG. 3 illustrates a beater portion of a system in an aspect of the present disclosure.

As shown in FIG. 3, beater portion 106 is coupled to connecting portion 104 at connector 300. Cable 208, or another motion-transferring device, can couple pedal portion 102 through connecting portion 104 to beater portion 106 as described with respect to FIGS. 1 and 2. Connector 300, or some other part within beater portion 106, may provide an additional disconnection point within system 100 as desired, as described with respect to FIG. 2 above.

Connecting portion 104, via connector 300, is coupled to drive shaft 124 in a similar manner as shown in FIG. 2, e.g., chain, cable, connector, etc., although other methods of connection to transfer motion are possible without departing from the scope of the present disclosure.

Shaft 302 is further coupled to pin 304. Pin 304 is coupled to spring 306, and spring 306 is coupled to cam 308. Cam 308 is coupled to beater rod holder 126. As cable 208 is moved within connecting portion 104, drive shaft 124 rotates, which pulls and/or pushes on beater rod holder 126. As beater rod holder 126 rotates, a beater coupled to beater rod holder 126 will strike a surface, e.g., the surface of a percussive instrument.

To control the strength and/or backswing of beater rod holder 126, cam 308 rotates, which pulls and/or pushes on spring 306. The position of pin 304 may be adjusted to control the tension on spring 306, which will control the amount of reverse tension on beater rod holder 126. Additionally, the resting position of the connection between the spring 306 and the cam 308, such as the position of the pin 328, can be adjusted. For example, the position of the pin 328 or other connector can be adjusted within an aperture 330 of the cam 308, thus adjusting the resting angle of the beater rod holder 126. Similar adjustment devices which can be used in embodiments of the present disclosure are described in commonly assigned U.S. Pat. Pub. No. 2015/0082968 to Sikra and U.S. Pat. App. No. 62/281,089 to Sikra, each of which is fully incorporated by reference herein in its entirety.

Beater rod 310 is coupled to a beater head 312, and beater rod 310 may be inserted in beater rod holder 126. A nut 314 is attached to beater rod holder 126 such that the height 326 of the beater head 312 with respect to bracket 120 may be adjusted. Beater rod holder 126 and the rotational axis of cam 308 are positioned to have a low rotational axis (also referred to as a "fulcrum point" herein), which is somewhat different than the typical rotational axis/fulcrum point of a drum pedal used for a bass drum.

For example, and not by way of limitation, the rotational axis of beater rod holder 126 may be between about 0.5 inch and 6 inches from floor, and/or between about 0.5 inch and 4 inches from the floor, and/or between about 1 inch and 3 inches from the floor, and/or about 2 inches from the floor, and/or less than 4 inches from the floor, and/or less than 3 inches from the floor (which may be the same plane as a bottom of the system 100, and/or the same plane as a bottom surface of bracket 120, or the bottom plane of beater portion 106), while the rotational axis of a beater rod holder in a bass drum pedal may be seven inches from the floor. Because system 100 may be used with different types of drums, e.g., a cajon, and such drums have different locations to strike to produce a desired sound, a desired location of the rotational axis of beater rod holder may be lower to the floor, as illustrated and described with respect to FIG. 3. However, the rotational axis location may still be adjusted within system 100, such as by changing a height attachment between body 316 and rod 122.

Further, a low fulcrum point, which, in an aspect of the present disclosure, may also be the rotational axis of drive shaft 124, allows for a different contact point with a drum surface than a typical natural contact point for a drummer's hands or other beaters. For example, and not by way of limitation, beater head 312, as configured with system 100, may be arranged to strike the face of a cajon at a specific point, while the drummer's hands strike the face of the cajon at a height above the contact point of the beater head 312. As such, the beater head 312 does not interfere with the drummer's hands, and the drummer can thus produce specific beats, sounds, and tones from the cajon without changing the specific preferred playing style that particular drummer employs.

Nut 314 may also adjust the attachment point between beater rod holder 126 and beater rod 310, which adjusts the height 326 and/or the location of beater head 312 with respect to the surface to be struck. By changing the distance between shaft 302 and cam 308, a larger moment arm is created, which changes the relative speed of beater head 312 with respect to a surface to be struck. As such, the amount of movement of pedal 108 employed to strike a surface with beater head 312 may be customized by changing the tension on spring 306 and/or the attachment point between beater rod 310 and beater rod holder 126 and/or the angle of the beater rod holder 126 as previously described.

In an aspect of the present disclosure, rotational control 318 controls the angle at which body 316 is coupled to rod 122. By loosening rotational control 318, which may be a threaded coupling between body 316 and rod 122, the entire body of beater portion 106 may be rotated through angle 320 with respect to bracket 120. This control allows for rotation of the beater rod holder 126, and thus, rotation of the beater head 312, with respect to the surface to be struck by beater head 312. Such rotational control gives additional clearance or adjustment between the locations where the beater head 312 strikes a surface with respect to locations where a drummer's hands or other beaters may strike the same surface. Further, minor changes in rotation via rotational control 318 may provide tuning of the drum, e.g., cajon, by changing the location where the beater head 312 strikes the cajon. Rotational control 318 may be loosened and/or tightened to fix a specific angle between beater portion 106 and a particular drum, and then repositioned to fix a different angle between beater portion 106 and another drum, further expanding the customizable features of system 100 of the present disclosure. Rotational control 318 may also control the distance between beater head 312 and the surface to be struck, as rotational control 318 may also move the connection point between body 316 and rod 122. This movement between body 316 (and thus beater head 312) may change the angle at which the beater head 312 strikes the surface of the drum, further changing the tones produced.

For example, and not by way of limitation, when placed at a first location on rod 122, the beater head 312 may strike the surface of the drum when the beater rod 310 is at a 90 degree angle as measured with respect to the floor. When rotational control 318 is loosened and body 316 is moved farther away from the surface of the drum to be struck, the beater head may strike the surface at an angle of over 90 degrees, such as shown in FIG. 3 as angle 322. Because connecting portion 104 may be coupled to beater portion 106 at or near arm 324 (another point that is coupled to drive shaft 124), the rotation of body 316, as well as the movement toward and/or away from bracket 120, may only minimally not affect the drummer's "feel" of the pedal 108, and/or may only minimally affect the tonal qualities of the percussive strike of beater head 312, other than those qualities that are selected to be altered by a particular drummer when setting up system 100 for a given drum.

Cajon System Interfacing

Figure 5:
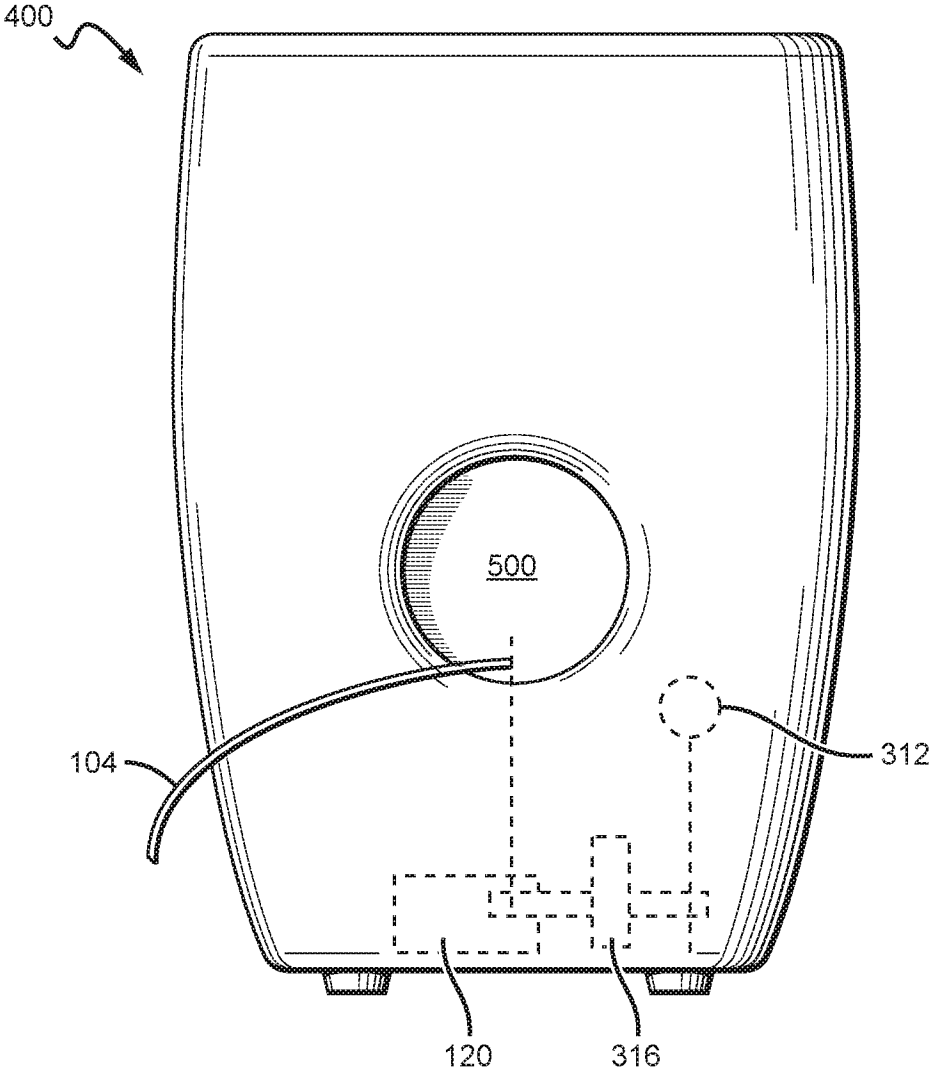
FIGS. 4 and 5 illustrate one embodiment of a drum which may be employed in accordance with various aspects of the present disclosure.
Figure 4:
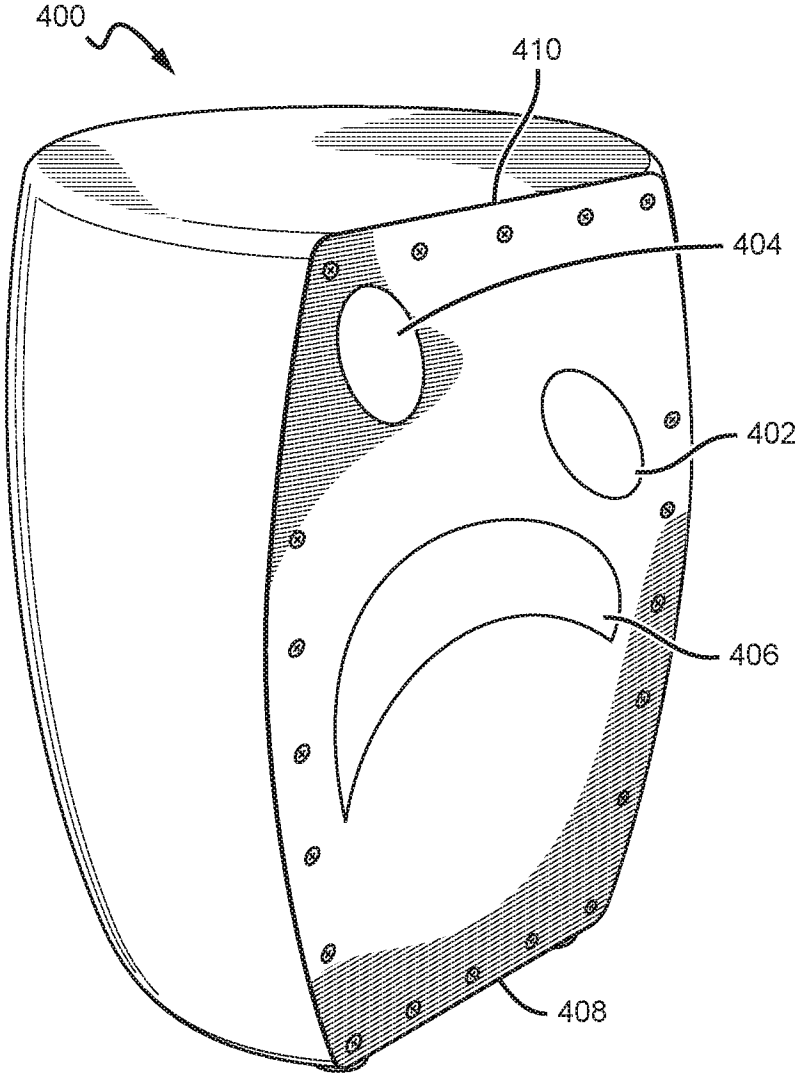

FIGS. 4-5 illustrate a drum which may be employed in accordance with various aspects of the present disclosure.

FIG. 4 illustrates a perspective view of a cajon 400. A cajon may be played by sitting on the top (shown at the top of FIG. 4) of cajon 400, and slapping the face(s) of cajon 400 with a user's hands. A particular user may slap the face of cajon 400 with their left hand in area 402, and with their right hand in area 404, as those areas may produce different tonal qualities from cajon 400. However, bracket 120 of system 100 of the present disclosure may be placed under cajon 400 at edge 408, and the player may adjust system 100 of the present disclosure to strike cajon 400 anywhere within area 406 (such as by adjusting via the previously described rotational control along the direction 320), such that a beater may produce different tonal qualities than hand slapping in areas 402 and 404 and/or may strike the cajon 400 in areas relatively distal from the natural striking area of the hands.

The sizes and/or areas described with respect to areas 402-406 are not to be considered limiting; as described herein, system 100 of the present disclosure may be customized and/or adjusted to strike cajon 400, or any percussive instrument, in any fashion without departing from the scope of the present disclosure. For example, and not by way of limitation, a bracket 120 may be used to attach system 100 to edge 410 of cajon 400, and movement of pedal 108 may then cause beater head 312 to strike cajon 400 in a different area, from the top rather than the bottom of cajon 400, or may be attached to cajon 400 on a side or the curved face of cajon 400, without departing from the scope of the present disclosure.

FIG. 5 illustrates a cajon in accordance with another aspect of the present disclosure.

Cajon 400 comprises a sound hole 500 which allows the reverberations of the hand/beater strike of cajon 400 to be heard by the audience, other musicians, and/or the drummer. In an aspect of the present disclosure, system 100 may be partially mounted within cajon 400, such that beater head 312 strikes the inside surface of cajon 400 rather than the surface being struck by the drummer. Since bracket 120, body 316, beater head 312, and other portions of system 100 may be inside of cajon 400 (or other percussive instrument), these portions of system 100 are shown in phantom lines in FIG. 5. In one embodiment, a bracket such as the bracket 120 is not included, which can allow for easier placement of the beater portion 106 within the cajon 400.

Because beater portion 106 may be removed from pedal portion 102, connecting portion may be sized to allow for mounting bracket 120 on a bottom, side, and/or any surface of cajon 400, such that beater head 312 can strike any surface of cajon 400. Further, since rotational control 318 allows for movement of body 316, the beater portion 106 may be easily moved, positioned, and/or removed from cajon 400 and mounted to a separate bracket 120 for use with another drum and/or cajon 400. Beater portion 106 may also be sized to fit in cajon 400, such that the parts of beater portion 106 fit inside sound hole 500 and can be mounted within cajon 400 without departing from the scope of the present disclosure.

Because rotational control 318 allows body 316 to be removed from rod 122, body 316 may be mounted on other rods that are used with drums and/or other percussive instruments. For instance, in one embodiment the beater portion 106 may be used with a cajon that includes an internal rod, such as an L-rod, that can be similar to rod 122, but mounted within the cajon and/or as part of the cajon in an area so as to enable mounting and actuation of the cajon inside surface. Thus, the body 316 can be removed from bracket 120 and rod 122 and reattached to the internal cajon rod (or other mount device). As another example, and not by way of limitation, body 316 may be mounted on the leg of a floor tom, or may be mounted on a bracket that is coupled to a tambourine or other cymbal, such that motion of pedal 108 will allow a beater head 312 to strike any percussive instrument. A floor tom, for example, may produce a different sound when being struck by a drum stick than when being struck with a beater head 312, and, as such, the tonal qualities that a drummer can produce with a given drum and/or drum set can be increased and expanded through the use of system 100 in such applications.

Additional System Views

FIGS. 6-9 illustrate additional views of a system in accordance with various aspects of the present disclosure.

Figure 6:
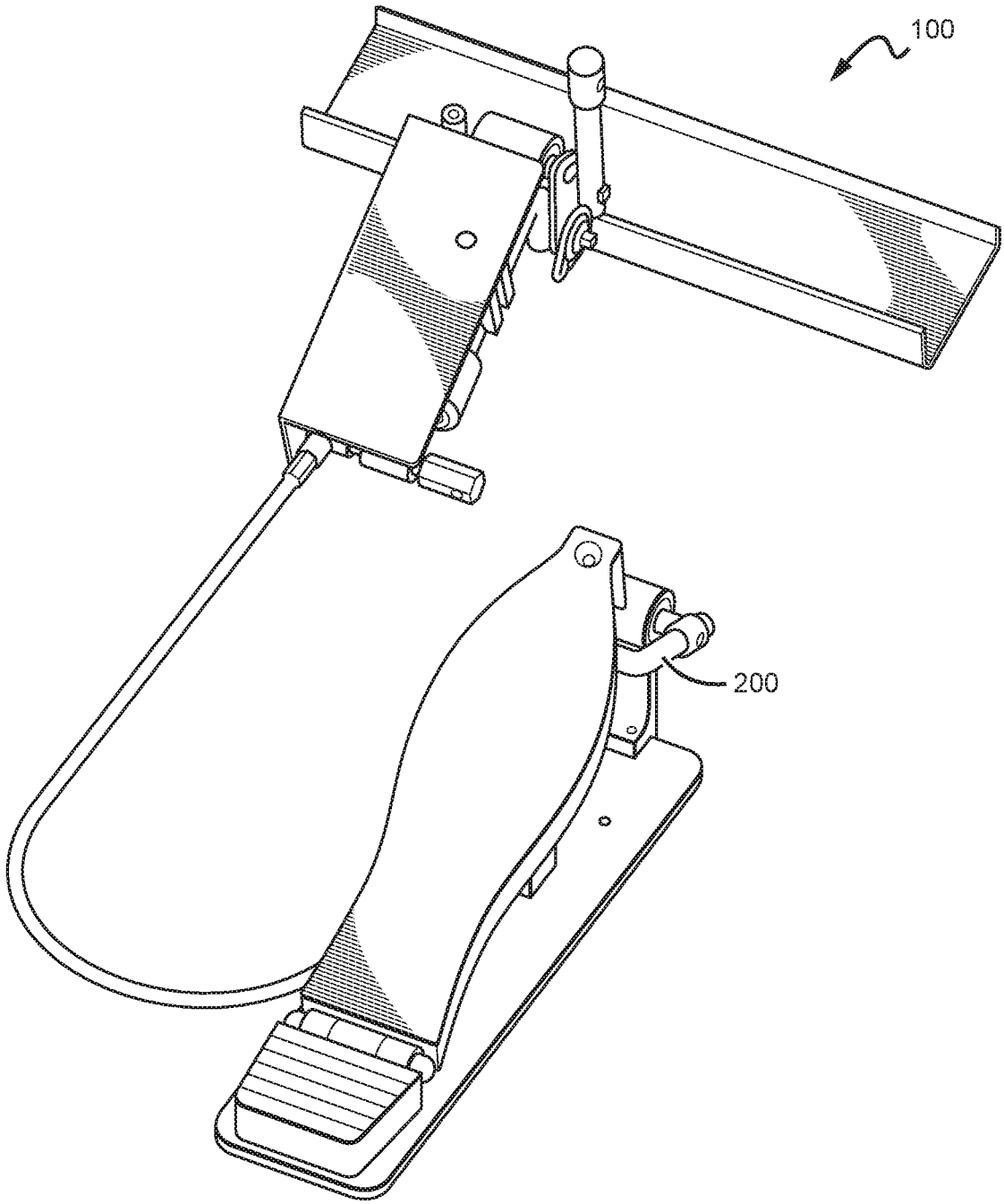
FIGS. 6-9 illustrate additional views of one embodiment of a system in accordance with various aspects of the present disclosure.

FIG. 6 illustrates a top-perspective view of system 100, which also illustrates the effect of longer and/or shorter roller arms 200 on pedal 108 movements.

Figure 7:
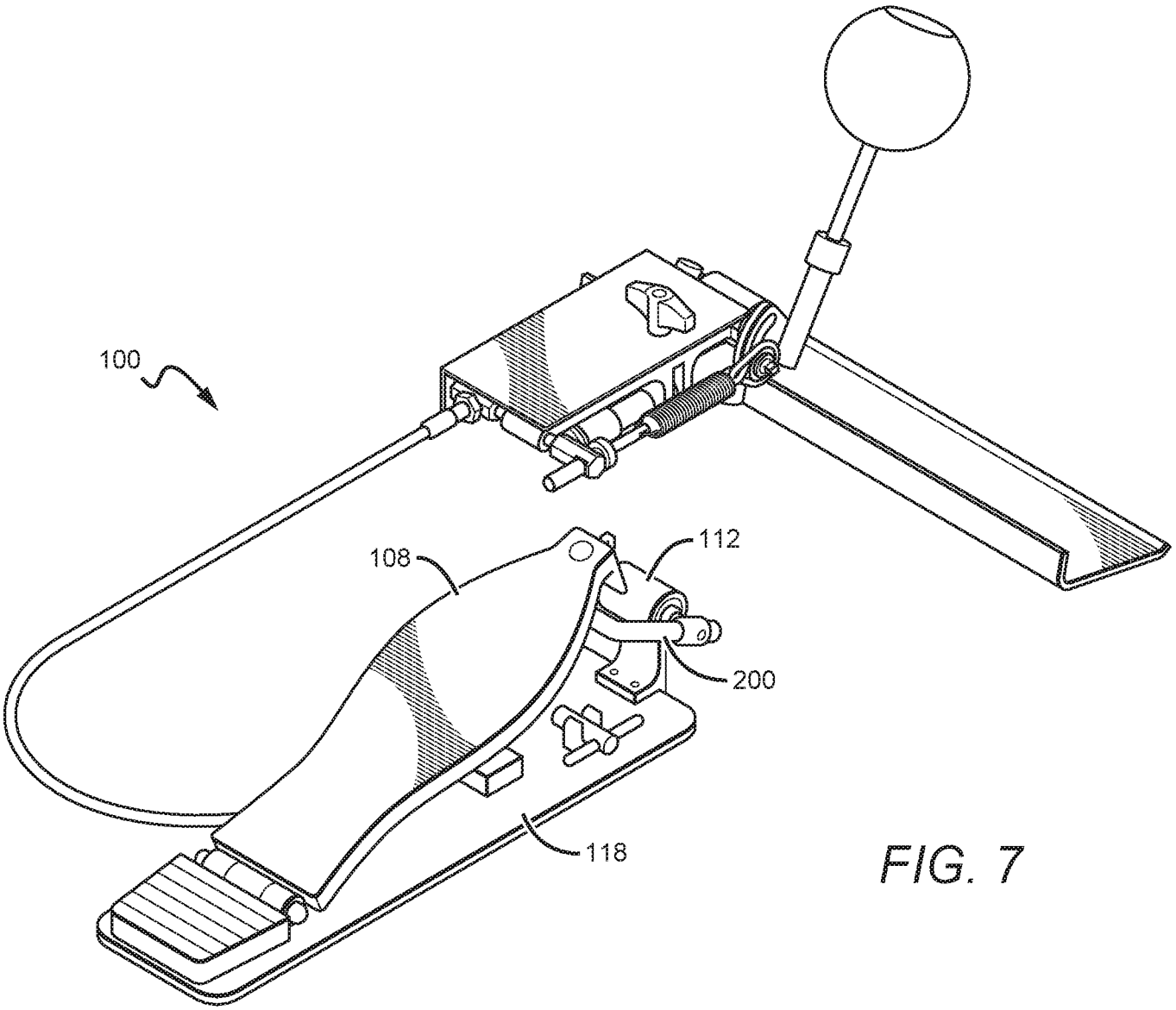

FIG. 7 illustrates a side-perspective view of system 100, which further illustrates the effect of longer and/or shorter roller arms 200 on pedal 108 movements. As roller arm 200 comprises a longer length (i.e., distance between drive shaft 112 and roller 110), roller 110 engages a different portion of pedal 108. For the same diameter roller 110, the height of pedal 108 (i.e., distance between pedal 108 and base 118) will be larger as roller arm 200 becomes longer.

Figure 8:
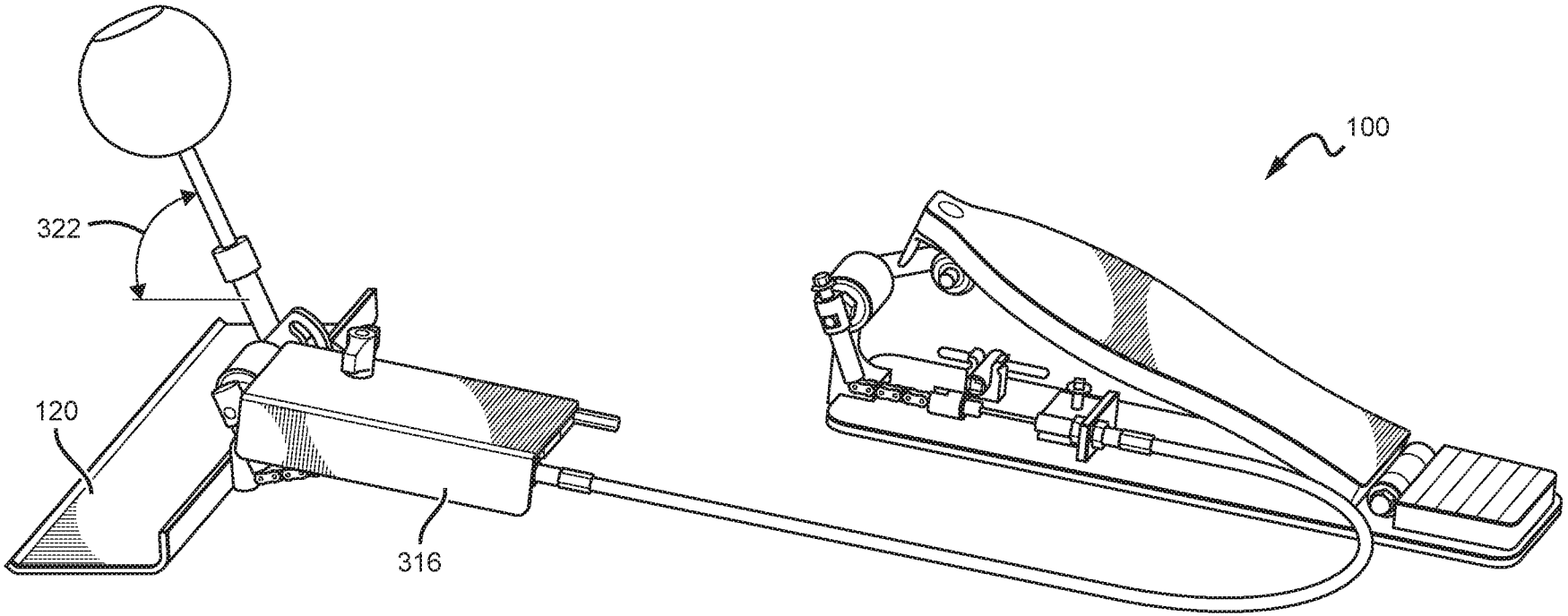

FIG. 8 illustrates a side-perspective view of system 100, which illustrates some angles 322 which can be taken by beater head 312. By adjusting the distance between body 316 and bracket 120, the angle 322 may be changed.

Figure 9:
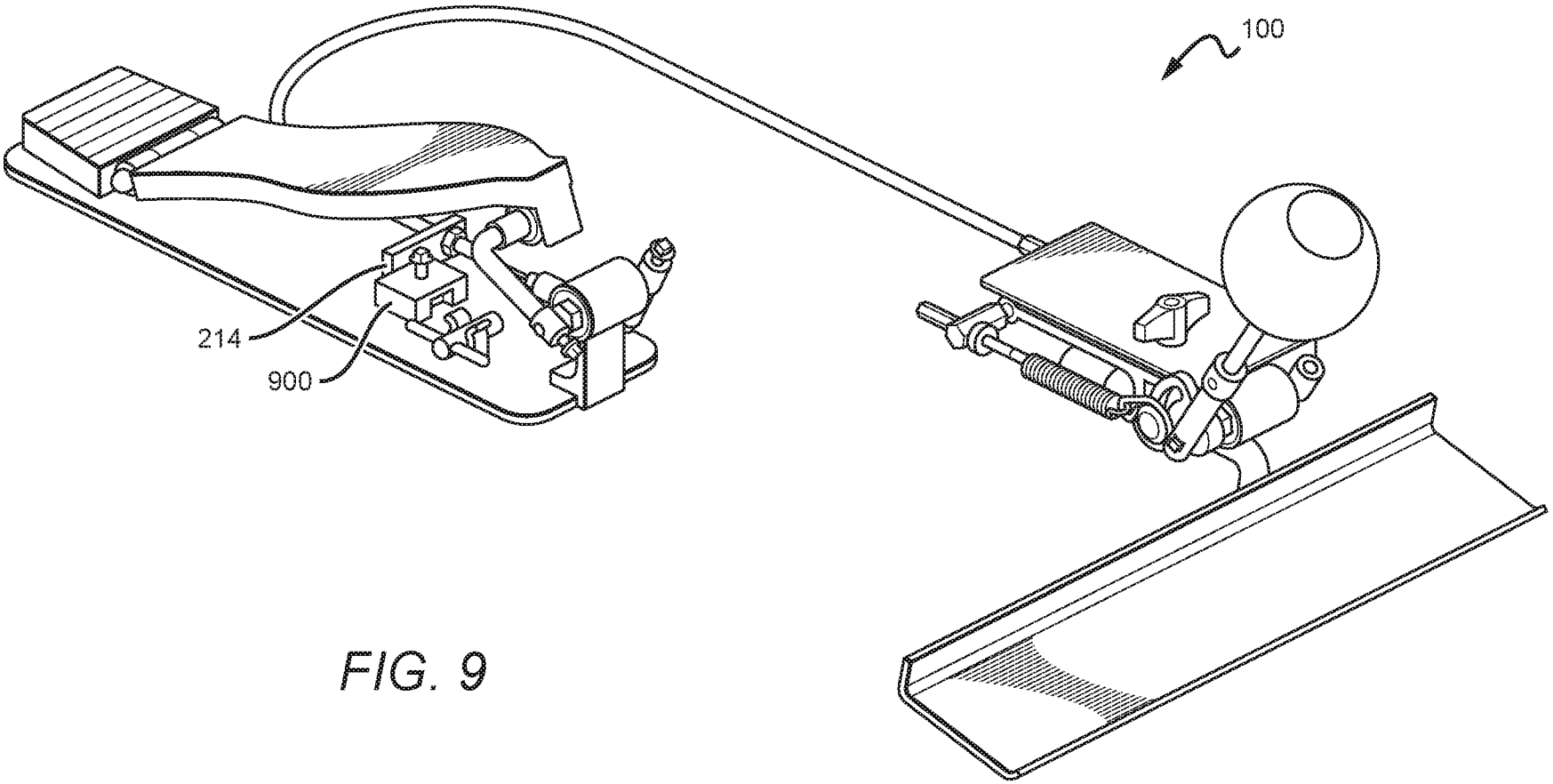

FIG. 9 illustrates a front-perspective view of system 100, which illustrates plate 214 coupling with bracket 900. Bracket 900 may allow for linear motion of plate 214 to allow for further adjustment of the connection between pedal portion 102 and connecting portion 104 in an aspect of the present disclosure. Such a connection between bracket 900 and plate 214 may be a male-female connection, slot-and-tab connection, a spring-loaded pin connection, a magnetic connection, and/or other fixed and/or variable connection that may provide for disconnection between pedal portion 102 and connecting portion 104 without departing from the scope of the present disclosure, and/or may be a combination of any of these types of connections. Similar connections may be provided in other aspects of the present disclosure between connecting portion 104 and beater portion 106.

Inset Views

Figure 10:
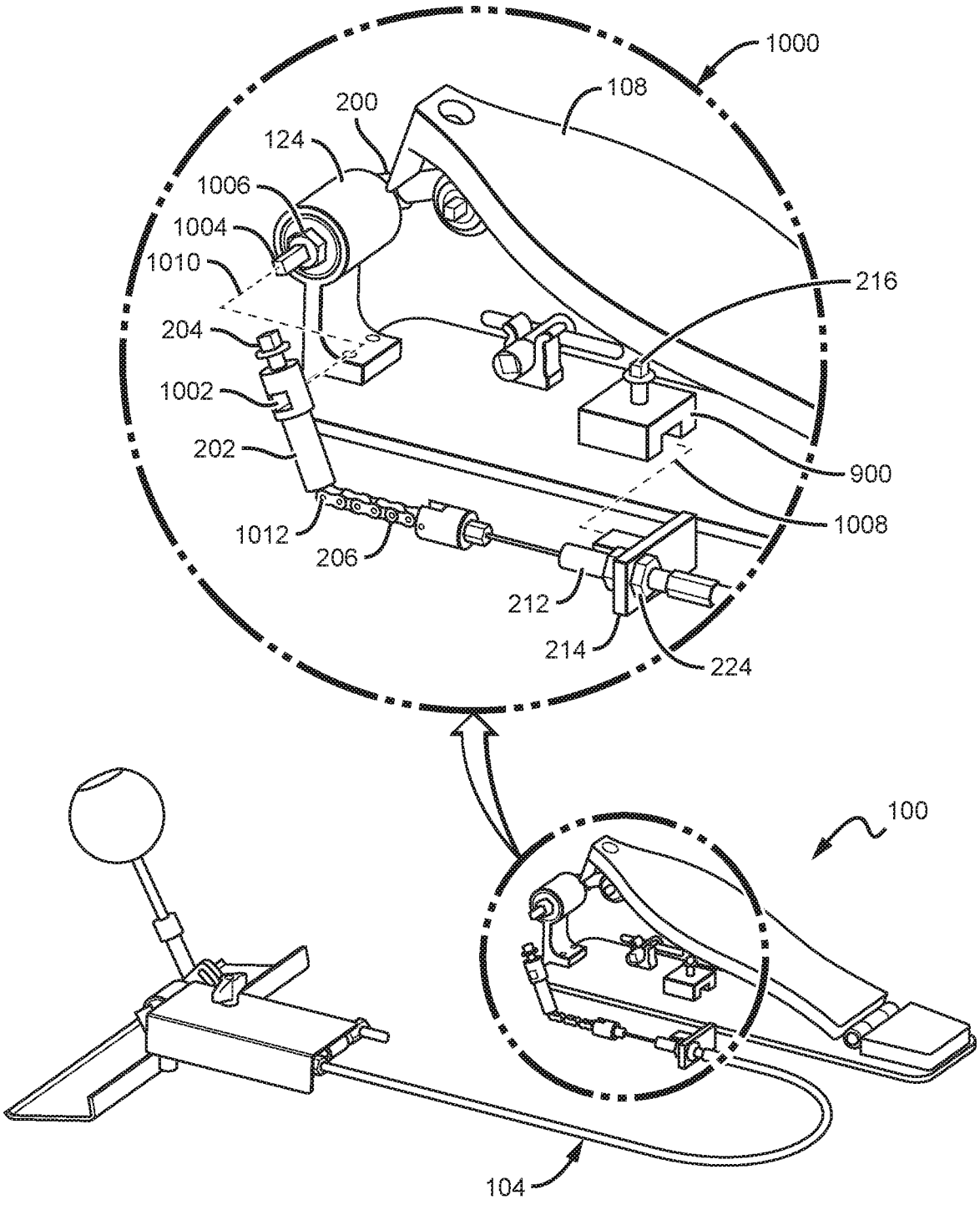
FIGS. 10 and 11 illustrate inset views of one embodiment of a system in accordance with various aspects of the present disclosure.
Figure 11:
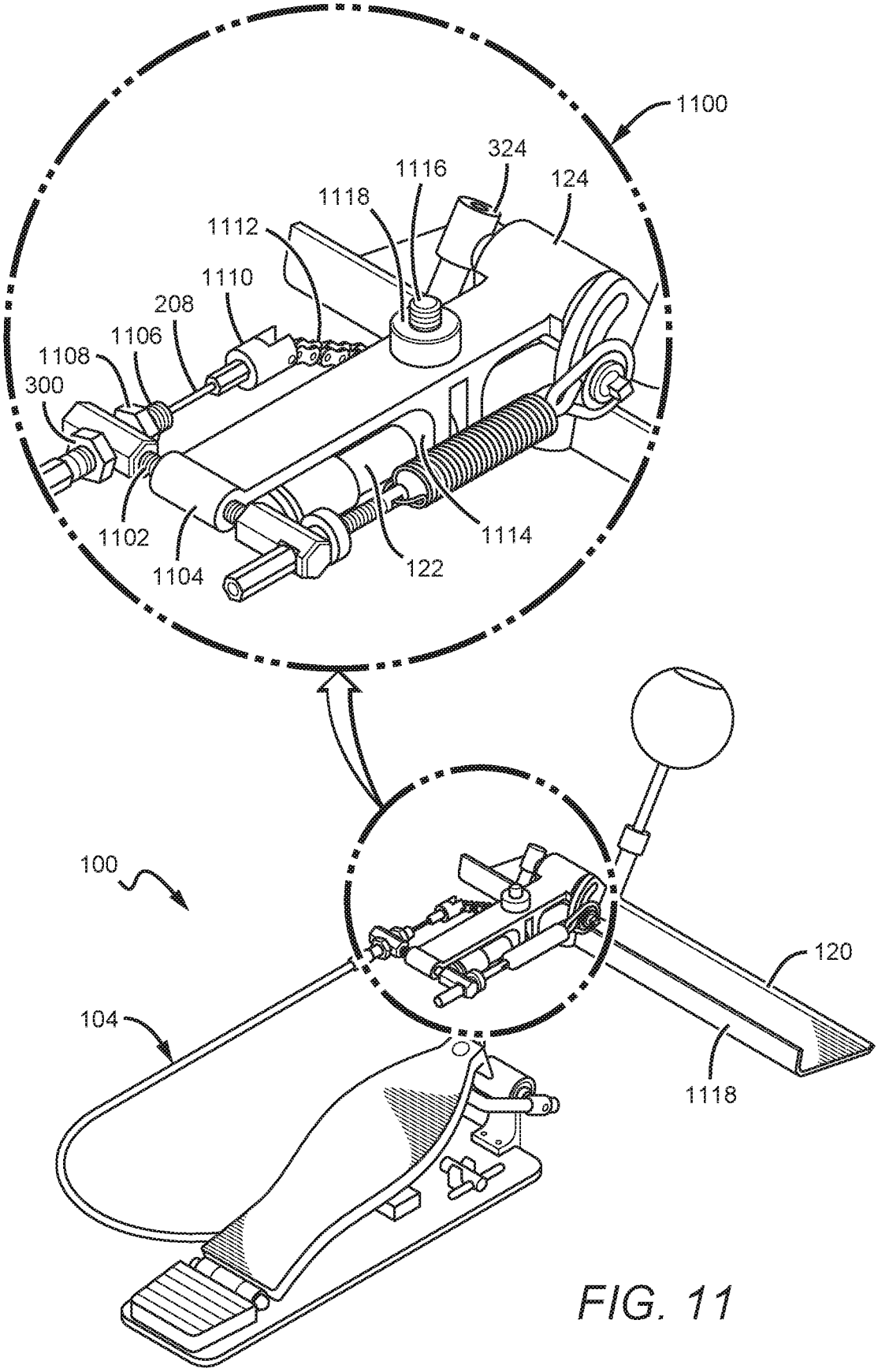

FIGS. 10-11 illustrate inset views of a system in accordance with various aspects of the present disclosure.

FIG. 10 illustrates an inset view 1000 of system 100. As shown in inset view 1000, to disconnect connecting portion 104 from pedal portion 102, nut 216 may be loosened to reduce pressure between bracket 900 and plate 214. In one embodiment nut 216 may be loosened such that the position of plate 214 relative to bracket 900 may be adjusted, and then nut 216 may be tightened so as to lock plate 214 into place relative to bracket 900. Another connection between connecting portion 104 and pedal portion 102 is arm 202, which is coupled to drive shaft 124 at interface 1002. Although interface 1002 is shown as a square mortise through arm 202, other shapes of interfaces, e.g., hexagonal, octagonal, round, elliptical, etc. may be employed without departing from the scope of the present disclosure. Further, nut 204 may or may not be employed to fix arm 202 to drive shaft 124.

Inset 1000 also shows additional details of drive shaft 124. Drive shaft 124 may comprise, for example, shaft 1004 and one or more bearings 1006. Shaft 1004 may be shaped on one end to couple to arm 202, and may have a similar or different shape to couple to roller arm 200.

Dashed line 1008 illustrates the coupling between plate 214 and bracket 900. Dashed line 1010 illustrates the coupling between arm 202 and shaft 1004. Because the distance between arm 202 (where chain 206 couples to arm 202 at point 1012) may be adjusted by nut 224, removing connecting portion 104 as shown in FIG. 10 does not appreciably change any adjustments made by a particular user, since the adjustments are kept appreciably constant as the arm 202 and plate 214 are removed. Although nut 216 may be used to couple bracket 900 and plate 214, other coupling mechanisms, e.g., a spring-loaded detent, a pinned hole in plate 214 and a pin that may be inserted through bracket 900 and plate 214, etc., without departing from the scope of the present disclosure.

FIG. 11 illustrates an inset view 1100 of beater portion 106 in an aspect of the present disclosure, with body 316 not shown and/or not included. Connector 300 is shown as coupled to rod 1102, which is coupled to body 1104 of beater portion 106. Similar to the connection described with respect to pedal portion 102, cable 208 emerges from connector 300 through a bushing 1106 and a nut 1108. An end of the cable is coupled to a connector 1110 which is coupled to a chain 1112. Chain 1112 is then coupled to arm 324, which is coupled to drive shaft 124. Movement of arm 324 moves (e.g., rotates) drive shaft 124, which moves beater rod holder 126.

Also shown in FIG. 11 is the coupling between body 1104 (which may be coupled to body 316 as described in FIG. 3) and rod 122. A portion 1114 of body 1104 is coupled around rod 122, and a bushing 1116 with an optional washer 1118 are shown. Rotational control 318 is coupled to bushing 1116, and by loosening and tightening bushing 1116 onto rod 122 with rotational control 318, the angle of body 1104 can be adjusted with respect to bracket 120 (and thus with respect to a surface of a drum located proximate to bracket 120). Tightening rotational control 318 (not shown) places pressure against rod 122, thus minimizing movement of the set rotated position of body 1104 with respect to a surface to be struck during play. Other attachment hardware and/or arrangements (including attachment hardware/arrangements included as part of a drum, such as inside a cajon as previously described) may be employed without departing from the scope of the present disclosure.

If desired, a second beater rod holder may be coupled to arm 324, to provide two beaters in a single beater portion 106. The beaters in the two beater rod holders 126 may have different beater heads, such that the two beaters produce two different tones from the same percussive instrument at substantially the same time.

Further illustrated in FIG. 11 is location 1118, which may be a second attachment point for a rod 122 on bracket 120. As such, a second pedal portion 102 and a second connecting portion 104 may be attached to a second beater portion 106 at location 1120. In such an aspect of the present disclosure, the system 100 can provide two pedals to strike two drum surfaces (whether of the same drum or of different drums), a drum surface and a tambourine, and/or any two percussive instruments independently. For example, and not by way of limitation, the second beater portion 106 can be arranged to strike the surface of a tambourine, and the first beater portion 106 can be arranged to strike the surface of a cajon. In such an aspect of the present disclosure, a drummer can approximate the hi-hat and bass drum of a drum set with a much smaller arrangement of pieces. Further, such an arrangement is easier to transport and takes up less room on stage and/or during transport.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a device. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

The description of the disclosure is provided to enable any person of reasonable skill to make or use the disclosure. Various modifications to the disclosure will be readily apparent to those of reasonable skilled, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein. Accordingly, the disclosure is not to be limited by the examples presented herein, but is envisioned as encompassing the scope described in the appended claims and the full range of equivalents of the appended claims.

I claim:

1. A drum pedal assembly comprising:

a base plate comprising a base plate rear and a base plate front;

a pedal on said base plate;

a linking member operably connected to said pedal;

a housing on said base plate between said base plate rear and said base plate front, and rearward of a front of said pedal; and a housing connection member connected to said housing at a height below said pedal, said linking member passing through said housing connection member;

said drum pedal assembly configured such that downward actuation of said pedal causes substantially linear forward motion of said linking member.

2. The drum pedal assembly of claim 1, wherein said housing connection member is a plate and said housing is a bracket.

3. The drum pedal assembly of claim 1, wherein said linking member is a cable, rope, wire, or chain.

4. The drum pedal assembly of claim 1, wherein a static position of said housing connection member when connected to said housing is adjustable.

5. The drum pedal assembly of claim 1, further comprising a drive shaft operably between said pedal and said linking member, said housing rearward of said drive shaft, said drum pedal assembly configured such that downward actuation of said pedal causes rotation of said drive shaft, which in turn causes said substantially linear forward motion of said linking member.

6. A drum pedal assembly comprising:

a base plate comprising a base plate rear and a base plate front;

a pedal on said base plate;

a cable;

a drive shaft operably between said pedal and said cable;

a housing on said base plate; and a plate connected to said housing, said cable passing through said plate;

said drum pedal assembly configured such that downward actuation of said pedal causes rotation of said drive shaft and substantially linear forward motion of said cable away from said housing and toward said base plate front.

7. The drum pedal assembly of claim 6, further comprising a roller connected to a first side of said drive shaft, wherein said cable is connected to a second side of said drive shaft opposite said first side, and wherein an underside of said pedal rests on said roller.

8. The drum pedal assembly of claim 6, wherein said plate is connected to said housing by a male-female connection, a drum screw, and a magnet.

9. The drum pedal assembly of claim 6, wherein said drive shaft is elevated from said base plate to a height less than a height of said pedal.

10. The drum pedal assembly of claim 9, wherein said drive shaft is in a drive shaft housing that is on said base plate.

11. The drum pedal assembly of claim 6, wherein said cable is connected to said drive shaft by an arm and/or a chain.

12. The drum pedal assembly of claim 6, wherein said drive shaft is connected to a roller on an underside of said pedal.

13. The drum pedal assembly of claim 12, wherein said drive shaft is connected to said roller by an arm angled downwardly from said roller to said drive shaft.

14. A drum pedal assembly comprising:

a base plate;

a pedal on said base plate;

a cable;

a drive shaft operably between said pedal and said cable, configured such that actuation of said pedal causes rotation of said drive shaft and substantially linear motion of said cable;

a housing on said base plate;

a plate connected to said housing, said cable passing through said plate; and a roller, wherein an underside of said pedal rests on said roller, wherein said roller is connected to a first side of said drive shaft, and wherein said cable is connected to a second side of said drive shaft;

said drum pedal assembly configured such that downward actuation of said pedal causes said roller to move along said underside of said pedal.

15. The drum pedal assembly of claim 14, configured such that downward actuation of said pedal causes said roller to move along said underside of said pedal so as to rotate said drive shaft and cause substantially linear forward motion of said cable.

16. The drum pedal assembly of claim 14, configured such that downward actuation of said pedal causes said roller to move along said underside of said pedal toward a hinge of said pedal.

17. The drum pedal assembly of claim 14, wherein said roller is connected to said drive shaft by an arm angled downwardly from said roller to said drive shaft.

18. The drum pedal assembly of claim 14, wherein said roller is substantially circular.

19. The drum pedal assembly of claim 18, wherein said roller has a diameter between 0.25 inches and 2 inches.

20. The drum pedal assembly of claim 14, wherein said housing is on said base plate between said base plate rear and said base plate front, and rearward of a front of said pedal.

21. The drum pedal assembly of claim 14, wherein said housing is on said base plate between said base plate rear and said base plate front, and rearward of said drive shaft.

* * * * *